US006160387A

United States Patent [19]

Moraghan

[11] Patent Number: 6,160,387

[45] Date of Patent: Dec. 12, 2000

[54] POWER TRANSISTOR CURRENT SENSING AND LIMITING APPARATUS

[75] Inventor: Paul Moraghan, Chicago, Ill.

[73] Assignee: Motorola, Inc., Schaumburg, Ill.

[21] Appl. No.: 09/456,353

[22] Filed: Dec. 8, 1999

[51] Int. Cl.[7] ..... G05F 1/573; G05F 3/04

[52] U.S. Cl. ..... 323/277; 323/312

[58] Field of Search ..... 323/266, 271, 323/273, 277, 312, 315, 907, 908; 327/538, 542, 543

[56] References Cited

U.S. PATENT DOCUMENTS 4,820,968 4/1989 Wrathall ..... 323/316
5,635,823 6/1997 Murakami et al. ..... 323/277
5,767,545 6/1998 Takahashi ..... 257/341
5,828,308 10/1998 Fukami ..... 340/664
5,909,112 6/1999 Kiyota et al. ..... 323/315

*Primary Examiner*—Matthew Nguyen
*Attorney, Agent, or Firm*—Simon B. Anolick

[57] ABSTRACT

A current through a transistor having a drain and a source is sensed using a resistor, and first and second current sources. The resistor is responsive to the first current source to establish a reference voltage between a first terminal and a second terminal. The second terminal of the resistor is coupled to the source of the transistor. The second current source is current-controlled by the first current source and has a current gain inversely related to a voltage between the drain of the transistor and the first terminal of the resistor.

39 Claims, 2 Drawing Sheets

POWER TRANSISTOR CURRENT SENSING AND LIMITING APPARATUS

TECHNICAL FIELD

The present invention relates to systems for sensing and limiting current associated with a power transistor.

BACKGROUND OF THE INVENTION

A known approach for sensing current flow through a power transistor comprises a delta VBE (i.e. a voltage between a base and an emitter of a transistor) circuit using a metal resistor as a sensing element. One drawback of this approach is that the metal resistor consumes an undesirably large area. Another drawback of this approach is that the temperature-dependent resistance of the metal resistor causes a temperature-dependent error component in the sensed current flow.

European Patent Publication No. 0-481-328-A2 discloses a sensing circuit capable of being integrated into a self-isolated DMOST. The sensing circuit is driven by a sensor resistor that is created from the DMOST drain metallization. The sensing circuit produces an output current that is proportional to the DMOST current.

U.S. Pat. No. 5,767,545 to Takahashi discloses a current detection means for a power MOSFET (metal oxide semiconductor field effect transistor). A series circuit of a sensing MOSFET and a converting MOSFET is connected in parallel to the power MOSFET. The converting MOSFET converts a shunted current flowing through the sensing MOSFET into a voltage signal.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

DETAILED DESCRIPTION OF PREFERRED EMBODIMENTS

Embodiments of the present invention advantageously use the drain-to-source resistance of a fully-enhanced field-effect power transistor as a current sensing element. As the current through the power transistor increases, the drain-to-source voltage increases. A current source responsive to the power transistor has a current gain inversely related to the drain-to-source voltage. Therefore, an output current provided by the current source is inversely related to the current through the power transistor.

Figure 1:
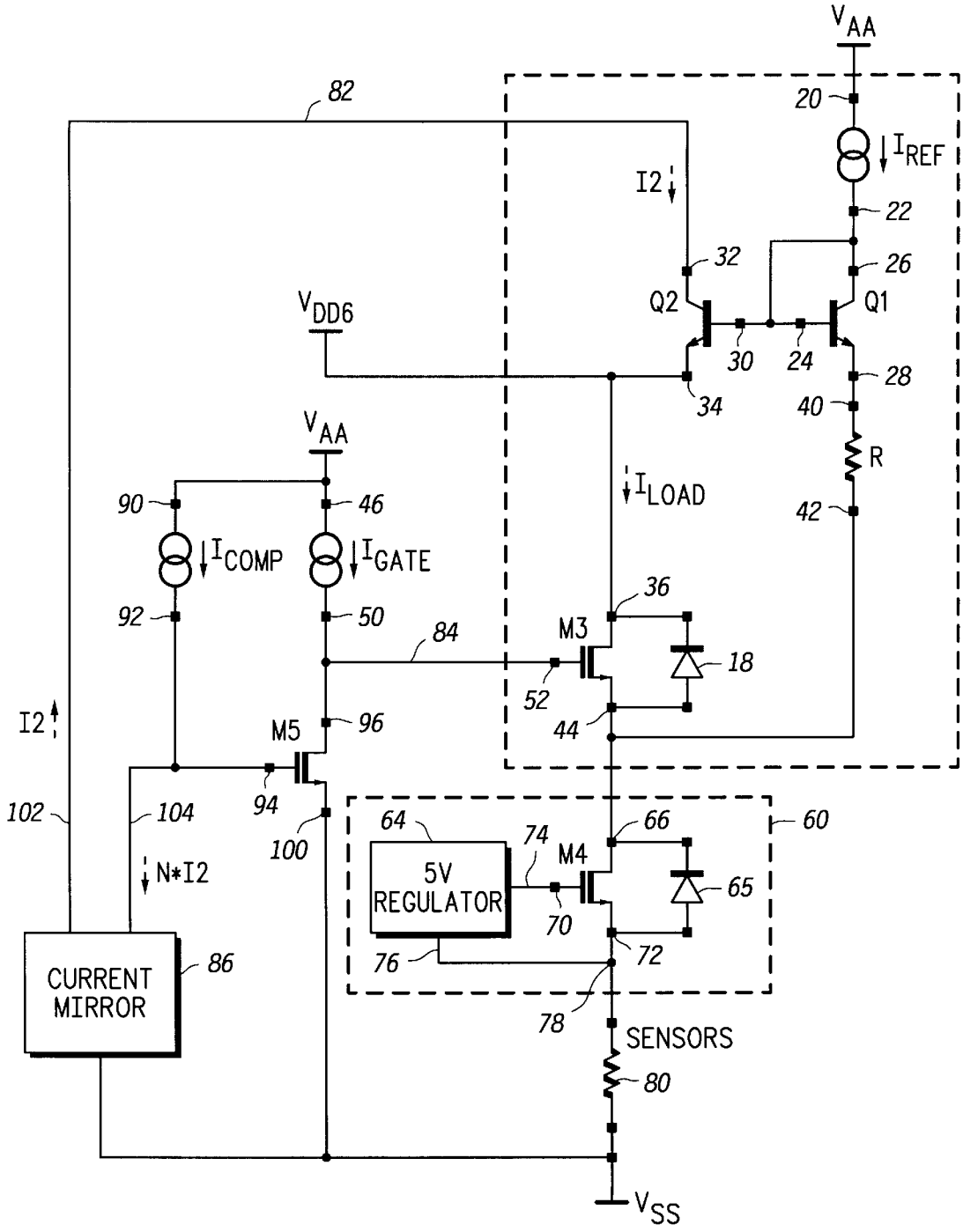
FIG. 1 is a schematic, block diagram of an embodiment of an apparatus in accordance with the present invention.

FIG. 1 is a schematic, block diagram of an embodiment of an apparatus in accordance with the present invention. The apparatus comprises a power transistor M3, such as an n-channel field effect transistor (NFET) having a reverse rectifier 18, whose load current flow during operation, ILOAD, is to be sensed.

A current source IREF, a transistor Q1, a transistor Q2, and a resistor R cooperate with the power transistor M3 to sense the load current ILOAD. The current source IREF has a first terminal 20 and a second terminal 22. The first terminal 20 is coupled to a supply line VAA.

The transistor Q1 has a base 24, a collector 26 and an emitter 28. The transistor Q1 is in a diode-connected form with the base 24 being coupled to the collector 26. The collector 26 is coupled to the second terminal 22 of the current source IREF.

The transistor Q2 has a base 30, a collector 32 and an emitter 34. The base 30 is coupled to the base 24 of the transistor Q1. The emitter 34 is coupled to a drain 36 of the power transistor M3. As illustrated, the transistors Q1 and Q2 may comprise bipolar junction transistors.

The resistor R has a first terminal 40 and a second terminal 42. The first terminal 40 is coupled to the emitter 28 of the transistor Q1. The second terminal is coupled to a source 44 of the power transistor M3. The resistor R is responsive to the current source IREF to establish a reference voltage between the first terminal 40 and the second terminal 42.

The transistors Q1 and Q2 cooperate to form a current-controlled current source having a current I2 at the collector of the transistor Q2 which is proportional to the current from the current source IREF. The current gain of the current-controlled current source is inversely related to a voltage between the drain 36 of the power transistor M3 and the first terminal 40 of the resistor R.

Under normal operation, i.e. when the load current ILOAD is less than a desired current limit, the power transistor M3 is fully enhanced by a current source IGATE. The current source IGATE has a first terminal 46 coupled to the supply line VAA and a second terminal 50 coupled to a gate 52 of the power transistor M3.

Being fully enhanced, the power transistor M3 behaves about as a low value resistor having a resistance denoted by rds(on). As the load current ILOAD increases, the voltage between the drain 36 and the source 44 of the power transistor M3 increases, and the voltage between the base 30 and the emitter 34 of the transistor Q2 decreases. The decrease in the voltage between the base 30 and the emitter 34 causes the current I2 through the collector 32 to decrease. Therefore, the current I2 is inversely related to the load current ILOAD.

Preferably, the resistor R and a channel of the power transistor M3 are composed of the same material. This mitigates the effect of temperature variation of rds(on) to the relationship between the current ILOAD and the current I2. Further, it is preferred that the transistors Q1 and Q2 are nearly-identical to mitigate the effect of temperature variation to the relationship between the current ILOAD and the current I2.

The aforementioned circuit for sensing the load current I2 may be used in a variety of applications. Of particular interest is an application in which the load current ILOAD is to be limited.

For example, consider the power transistor M3 being used to couple a supply line VDD to a voltage regulator circuit 60. In particular, the drain 36 of the power transistor M3 is coupled to the supply line VDD and the source 44 of the power transistor M3 is coupled to an input 62 of the voltage regulator circuit 60.

The voltage regulator circuit 60 comprises a voltage regulator 64 and a power transistor M4. As illustrated, the power transistor M4 may comprise an NFET having a reverse rectifier 65. The power transistor M4 has a drain 66 coupled to the source 44 of the power transistor M3, and a gate 70 and a source 72 coupled to terminals 74 and 76 of the voltage regulator. The power transistor M4 is used to extend the range of current provided at an output 78 of the voltage regulator circuit 60.

A load 80 is coupled between the output 78 and a voltage supply line VSS. The load 80 may comprise one or more sensors, for example.

The load current ILOAD is to be limited in the event of a fault condition. An example of a fault condition includes an undesirably low resistance, such as a short, between the output 78 of the voltage regulator circuit 60 and the line VSS.

A circuit, having an input 82 coupled to the collector 32 of the transistor Q2 and an output 84 coupled to the gate 52 of the power transistor M3, functions to limit the load current ILOAD. The circuit comprises a current source ICOMP, a transistor M5 and a current mirror 86.

The current source ICOMP has a first terminal 90 coupled to the supply line VAA and a second terminal 92 coupled to a gate 94 of the transistor M5. The transistor M5 has a drain 96 coupled to the gate 52 of the power transistor M3, and a source 100 coupled to the line VSS. As illustrated, the transistor M5 may comprise an NFET.

The current mirror 86 has an input 102 coupled to the collector 32 of the transistor Q2 and an output 104 coupled to the gate 94 of the transistor M5. For a current I2 drawn at the input 102, the output 104 is capable of sinking a current proportional thereto, namely n*I2, from the current source ICOMP. Therefore, the current source ICOMP is used to pull up the gate 94 of the transistor M5, and the current mirror 86 is used to pull down the gate 94.

The constant current provided by the current source ICOMP and the value of n are chosen so that: (i) when ILOAD is less than the desired current limit, the transistor M5 is off; (ii) when ILOAD is about equal to the desired current limit, the magnitude of the current n*I2 is about equal to the magnitude of the current from the current source ICOMP; and (iii) when ILOAD is greater than the desired current limit, the magnitude of n*I2 is less than the magnitude of the current source ICOMP, and the transistor M5 begins to turn on. As the transistor M5 turns on, the voltage at the gate 52 of the power transistor M3 decreases. The decrease in the voltage at the gate 52 causes the load current ILOAD to decrease.

In one application, the herein-described apparatus is part of an integrated circuit which is a control chip for a flyback switched-mode power supply (SMPS) with several windings. Here, the VDD supply line is from a winding which produces an unregulated 6V used to derive the 5V supply provided by the voltage regulator circuit 60. The VAA supply line is from a winding which produces an unregulated 10V for gate drive. The VSS line provides a common reference for the VDD and VAA supply lines. The load 80 is external to the integrated circuit.

It is noted that the current sources IREF, ICOMP and IGATE preferably are constant current sources. As used herein, the term ▒ constant current source▒ is inclusive of current sources which produce a nearly-constant current over a range of operating and loading conditions.

Figure 2:
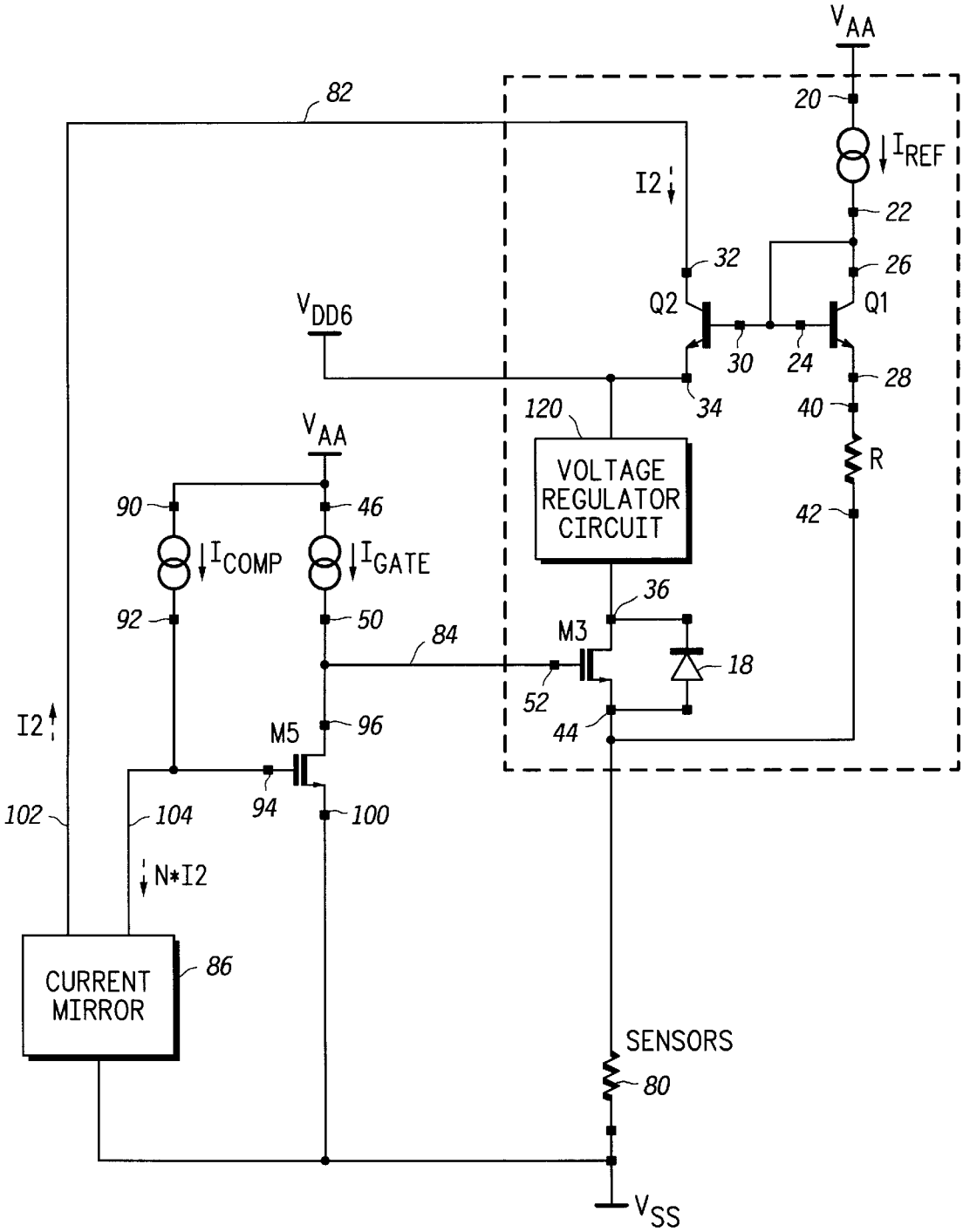
FIG. 2 is a schematic, block diagram of another embodiment of an apparatus in accordance with the present invention.

FIG. 2 is a schematic, block diagram of another embodiment of an apparatus in accordance with the present invention. This embodiment is substantially similar to the embodiment of FIG. 1, except with respect to the location of a voltage regulator circuit 120. In this embodiment, the voltage regulator circuit 120 is interposed between the emitter 34 of the transistor Q2 and the drain 36 of the power transistor M3. The voltage regulator circuit 120 is the same as the voltage regulator circuit 60 described with reference to FIG. 1. The load 80 is coupled between the source 44 of the power transistor M3 and the voltage supply line VSS.

Thus, there has been described herein several embodiments including preferred embodiments of a power transistor current sensing apparatus.

Beneficially, embodiments of the present invention provide a current-sensing circuit which: (i) can be integrated with a voltage regulator circuit; (ii) exhibit a low power dissipation and a low voltage drop; and (iii) does not degrade the accuracy of the output of the voltage regulator circuit.

It will be apparent to those skilled in the art that the disclosed invention may be modified in numerous ways and may assume many embodiments other than the preferred forms specifically set out and described above. For example, in alternative embodiments, some pairs of components may be indirectly coupled rather than being directly coupled as in the preferred forms. Therefore, the term ▒ couple▒ as used herein is inclusive of both directly coupled and indirectly coupled. By indirectly coupled, it is meant that a pair of components are coupled by one or more intermediate components.

As a further alternative, the power transistor M3 may be employed in an inverse mode, wherein the drain 36 and the source 44 are reversed in either FIGS. 1 or 2. In this case, for the embodiment of FIG. 1, the source 44 is coupled to the emitter 34 and the drain 36 is coupled to the second terminal 42 of the resistor R. The current gain of the current-controlled current source (comprised of the transistors Q1 and Q2) is inversely related to the voltage between the source 44 and the first terminal 40 of the resistor R. For the embodiment of FIG. 2, the source 44 is coupled to the voltage regulator circuit 120 and the drain 36 is coupled to the second terminal 42 of the resistor R.

As a still further alternative, current limiting may be achieved by pulling down the gate 70 of the power transistor M4 rather than the gate 52 of the power transistor M3.

Accordingly, it is intended by the appended claims to cover all modifications of the invention which fall within the true spirit and scope of the invention.

What is claimed is:

1. An apparatus comprising:

a first current source;

a first transistor having a base, a collector and an emitter, wherein the base is coupled to the collector, and the collector is coupled to the first current source;

a second transistor having a base, a collector and an emitter, wherein the base is coupled to the base of the first transistor;

a resistor having a first terminal and a second terminal, wherein the first terminal is coupled to the emitter of the first transistor; and a third transistor having a gate, a drain and a source, wherein the drain is coupled to the emitter of the second transistor, and the source is coupled to the second terminal of the resistor.

2. The apparatus of claim 1 wherein the resistor and a channel of the third transistor are composed of the same material.

3. The apparatus of claim 1 wherein the third transistor is fully enhanced.

4. The apparatus of claim 1 further comprising:

a second current source coupled to the gate of the third transistor;

a fourth transistor having a gate, a drain and a source, the drain coupled to the gate of the third transistor;

a third current source coupled to the gate of the fourth transistor; and a current mirror having an input coupled to the collector of the second transistor and an output coupled to the gate of the fourth transistor.

5. The apparatus of claim 4 wherein the output of the current mirror is to sink a current proportional to a current drawn at the input.

6. The apparatus of claim 1 further comprising a circuit having an input coupled to the collector of the second transistor and an output coupled to the gate of the third transistor.

7. The apparatus of claim 6 wherein the circuit is to decrease a voltage at the gate of the third transistor if a current through the input exceeds a limit.

8. The apparatus of claim 1 further comprising a voltage regulator responsive to the source of the third transistor.

9. The apparatus of claim 8 wherein the resistor, the first transistor, the second transistor and the third transistor are integrated with the voltage regulator.

10. The apparatus of claim 8 wherein the drain of the third transistor is further coupled to a supply line.

11. The apparatus of claim 1 further comprising a voltage regulator circuit interposed between the drain of the third transistor and the emitter of the second transistor.

12. An apparatus comprising:

a first current source;

a first transistor having a base, a collector and an emitter, wherein the base is coupled to the collector, and the collector is coupled to the first current source;

a second transistor having a base, a collector and an emitter, wherein the base is coupled to the base of the first transistor;

a resistor having a first terminal and a second terminal, wherein the first terminal is coupled to the emitter of the first transistor; and a third transistor having a gate, a drain and a source, wherein the source is coupled to the emitter of the second transistor, and the drain is coupled to the second terminal of the resistor.

13. The apparatus of claim 12 wherein the resistor and a channel of the third transistor are composed of the same material.

14. The apparatus of claim 12 wherein the third transistor is fully enhanced.

15. The apparatus of claim 12 further comprising:

a second current source coupled to the gate of the third transistor;

a fourth transistor having a gate, a drain and a source, the drain coupled to the gate of the third transistor;

a third current source coupled to the gate of the fourth transistor; and a current mirror having an input coupled to the collector of the second transistor and an output coupled to the gate of the fourth transistor.

16. The apparatus of claim 15 wherein the output of the current mirror is to sink a current proportional to a current drawn at the input.

17. The apparatus of claim 12 further comprising a circuit having an input coupled to the collector of the second transistor and an output coupled to the gate of the third transistor.

18. The apparatus of claim 17 wherein the circuit is to decrease a voltage at the gate of the third transistor if a current through the input exceeds a limit.

19. The apparatus of claim 12 further comprising a voltage regulator responsive to the drain of the third transistor.

20. The apparatus of claim 19 wherein the resistor, the first transistor, the second transistor and the third transistor are integrated with the voltage regulator.

21. The apparatus of claim 19 wherein the source of the third transistor is further coupled to a supply line.

22. The apparatus of claim 12 further comprising a voltage regulator circuit interposed between the source of the third transistor and the emitter of the second transistor.

23. An apparatus comprising:

a transistor having a drain, a source and a gate;

a first current source;

a resistor having a first terminal and a second terminal, the second terminal coupled to the source of the transistor, the resistor responsive to the first current source to establish a reference voltage between the first terminal and the second terminal; and a second current source which is current-controlled by the first current source and has a current gain inversely related to a voltage between the drain of the transistor and the first terminal of the resistor.

24. The apparatus of claim 23 wherein the resistor and a channel of the transistor are composed of the same material.

25. The apparatus of claim 23 wherein the transistor is fully enhanced.

26. The apparatus of claim 23 further comprising a circuit having an input coupled to second current source and an output coupled to the gate of the transistor.

27. The apparatus of claim 26 wherein the circuit is to decrease a voltage at the gate of the transistor if a current through the input exceeds a limit.

28. The apparatus of claim 23 further comprising a voltage regulator responsive to the source of the transistor.

29. The apparatus of claim 28 wherein the resistor, the transistor, the first current source and the second current source are integrated with the voltage regulator.

30. The apparatus of claim 23 wherein the drain of the transistor is further coupled to a supply line.

31. An apparatus comprising:

a transistor having a drain, a source and a gate;

a first current source;

a resistor having a first terminal and a second terminal, the second terminal coupled to the drain of the transistor, the resistor responsive to the first current source to establish a reference voltage between the first terminal and the second terminal; and a second current source which is current-controlled by the first current source and has a current gain inversely related to a voltage between the source of the transistor and the first terminal of the resistor.

32. The apparatus of claim 31 wherein the resistor and a channel of the transistor are composed of the same material.

33. The apparatus of claim 31 wherein the transistor is fully enhanced.

34. The apparatus of claim 31 further comprising a circuit having an input coupled to second current source and an output coupled to the gate of the transistor.

35. The apparatus of claim 34 wherein the circuit is to decrease a voltage at the gate of the transistor if a current through the input exceeds a limit.

36. The apparatus of claim 31 further comprising a voltage regulator responsive to the drain of the transistor.

37. The apparatus of claim 36 wherein the resistor, the transistor, the first current source and the second current source are integrated with the voltage regulator.

38. The apparatus of claim 31 wherein the source of the transistor is further coupled to a supply line.

39. An integrated circuit comprising:

a first current source having a first terminal and a second terminal, the first terminal coupled to a first supply line;

a first transistor having a base, a collector and an emitter, wherein the base is coupled to the collector, and the collector is coupled to the second terminal of the first current source;

a second transistor having a base, a collector and an emitter, wherein the base is coupled to the base of the first transistor;

a resistor having a first terminal and a second terminal, wherein the first terminal is coupled to the emitter of the first transistor;

a third transistor having a gate, a drain and a source, wherein the drain is coupled to the emitter of the second transistor and to a second supply line, and the source is coupled to the second terminal of the resistor;

a voltage regulator responsive to the source of the third transistor;

a second current source having a first terminal coupled to the first supply line and a second terminal coupled to the gate of the third transistor;

a fourth transistor having a gate, a drain and a source, the drain coupled to the gate of the third transistor, the source coupled to a third supply line;

a third current source having a first terminal coupled to the first supply line and a second terminal coupled to the gate of the fourth transistor; and a current mirror having an input coupled to the collector of the second transistor and an output coupled to the gate of the fourth transistor, the output to sink a current proportional to a current drawn at the input.

* * * * *